United States Patent [19]

Weyer

[11] 4,373,426

[45] Feb. 15, 1983

[54] ROTARY ACTUATOR

[76] Inventor: Paul P. Weyer, c/o Weyer Machine Co. Inc., 1462 Blake St., Enumclaw, Wash. 98022

[21] Appl. No.: 203,156

[22] Filed: Nov. 3, 1980

Related U.S. Application Data

[62] Division of Ser. No. 960,043, Nov. 13, 1978, abandoned.

[51] Int. Cl.[3] ..... F15B 15/22; F01B 3/00

[52] U.S. Cl. ..... 91/396; 92/33; 92/85 B; 92/169

[58] Field of Search ..... 92/31, 33, 32, 169; 91/394, 396

[56] References Cited

U.S. PATENT DOCUMENTS

| | | | |
|---|---|---|---|
| 2,688,951 | 9/1954 | Seors | 92/31 |
| 2,959,064 | 11/1960 | Geyer et al. | 92/33 |
| 3,175,725 | 3/1965 | Sampson | 91/394 |
| 3,786,728 | 1/1974 | Sheesley et al. | 92/33 |
| 4,152,972 | 5/1979 | Fylling | 92/31 |

FOREIGN PATENT DOCUMENTS

| | | | |
|---|---|---|---|
| 2115707 | 2/1972 | Fed. Rep. of Germany | 92/33 |

*Primary Examiner*—Paul E. Maslousky

*Attorney, Agent, or Firm*—Seed, Berry, Vernon & Baynham

[57] ABSTRACT

A helical rotary actuator has a torque transmitting section that can be a sealing section or a clearance section but which is welded to a ring gear so that torque forces imposed on the ring gear can be carried through the torque transmitting section to the base of the actuator. In the method of fabrication, the splines on the ring gear are cut after a weldment is made between the ring gear and the torque transmitting section of the cylinder. The pistons within the cylinder are hydraulically cushioned.

5 Claims, 2 Drawing Figures

ROTARY ACTUATOR

This is a division of application Ser. No. 960,043, filed Nov. 13, 1978 now abandoned.

BACKGROUND OF THE INVENTION

1. Field of the Invention

This invention pertains to rotary actuators of the type in which reciprocation of a piston causes simultaneous rotation through interengaging helical splines within the cylinder.

2. Description of the Prior Art

Helical rotary actuators are known. Examples are shown in U.S. Pat. Nos. 3,213,923; 3,453,938; 2,283,185; 2,117,225; 3,133,476; 3,141,387; 2,429,863 and 3,319,925. All of these known actuators, however, are expensive to manufacture greatly reducing their competitive usefulness relative to other types of rotary actuators.

In rotary actuators of the type having a hydraulically or pneumatically powered reciprocating piston in particular, and in other linear devices using a reciprocating piston in general, it is frequently desirable to adjust the limit of stroke of the piston to adjust the rotational or linear end position of the output member. In an embodiment of this invention the adjustment of the limit of piston stroke is obtained by threadably adjusting an end cap of the cylinder within the cylinder. When rotational adjustment of a cylinder end cap is thus encouraged, it frequently becomes unthreaded for such adjustment beyond the number of turns recommended by the manufacturer and the pressure in the cylinder over stresses the few threads left holding the end cap, causing the end cap to be blown off the cylinder.

SUMMARY OF THE INVENTION

It is an object of this invention to provide an inexpensive helical rotary actuator.

It is another object of this invention to provide an improved helical rotary actuator method of manufacture.

It is still another object of this invention to provide a higher strength, lower cost helical rotary actuator.

Basically, these objects are obtained by forming the actuator out of two sections, one of which is a torque transmitting section that is welded to the helically splined ring gear which transmits the torque from the splines in the reciprocating piston to the torque transmitting section and from thence to the base. In this manner the remaining section can be either welded or bolted to the ring gear. In addition, the welding technique also substantially reduces the assembly time in making the actuators.

The method objects of this invention are basically achieved by welding the torque transmitting section of the actuator to the ring gear. Next, either the remaining section is welded to the ring gear and the ring gear splines are cut, or the ring gear splines are cut and then the remaining section is bolted to the ring gear. In either case, however, the method employs the step of cutting the helical splines in the ring gear after the ring gear has been welded to the torque transmitting section. This technique reduces substantially the amount of assembly time required to manufacture the rotary actuators and enables the teeth in the ring gear to be very accurately cut and maintained in alignment during the final fabrication of the rotary actuator.

In the preferred embodiment hydraulic cushioning is provided to slow the stroke of the piston at the extremes of travel and the amount of travel can be controlled by an adjustable end stop.

DETAILED DESCRIPTION OF THE PREFERRED EMBODIMENTS

Figure 1:
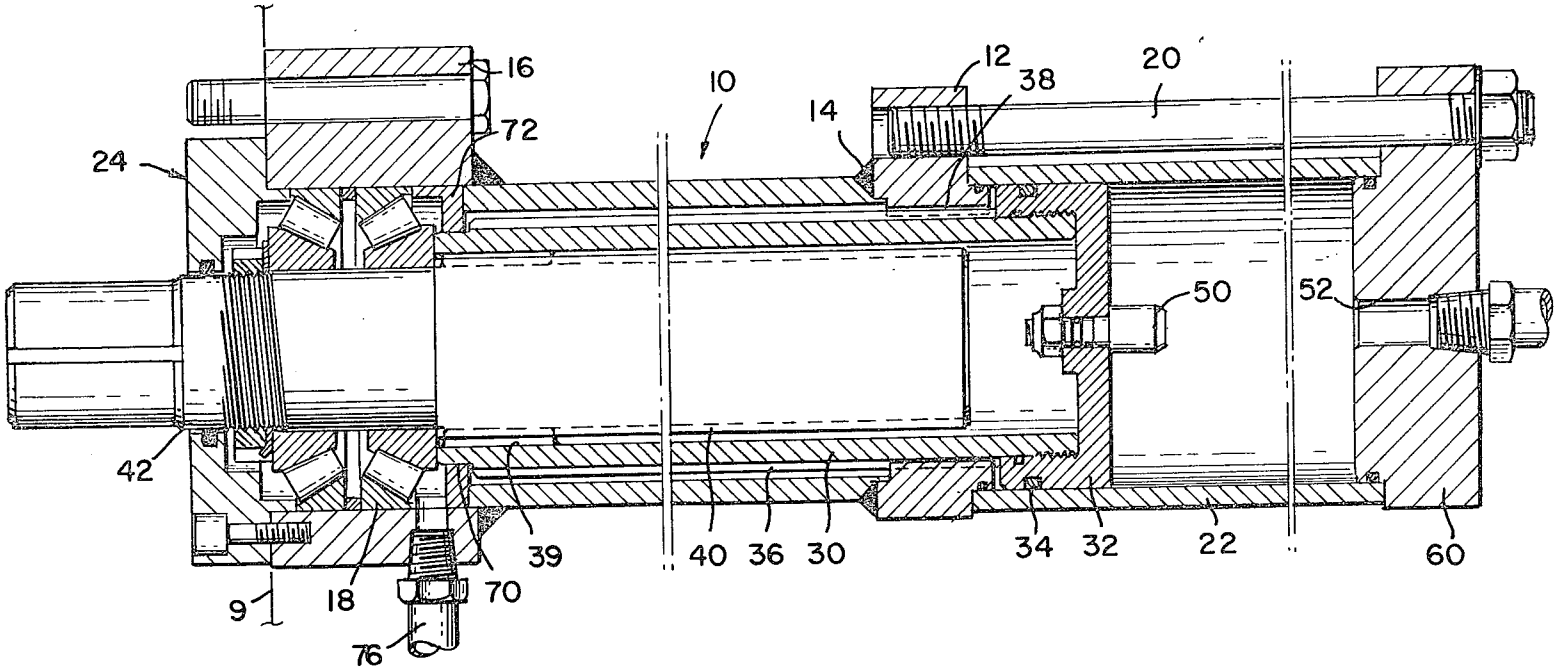
FIG. 1 is a diametrical section of one embodiment of helical rotary actuator embodying the principles of the invention.

As best shown in FIG. 1 a helical rotary actuator has a torque transmitting section 10 welded to a ring gear 12 by a circumferential weldment 14. The torque transmitting section is welded to a bearing section 16 which houses a standard roller bearing 18. Connected to the ring gear 12 by tie rods or bolts 20 is a second section 22 which can be formed of lower strength material because the torque transmission forces acting on the ring gear 12 are transmitted through the torque transmitting section 10 thence to the bearing section 16 of a base 24. As is understood, the base 24 is rigidly secured to a surface 9 which can withstand any of the rotational torque.

Figure 1A:
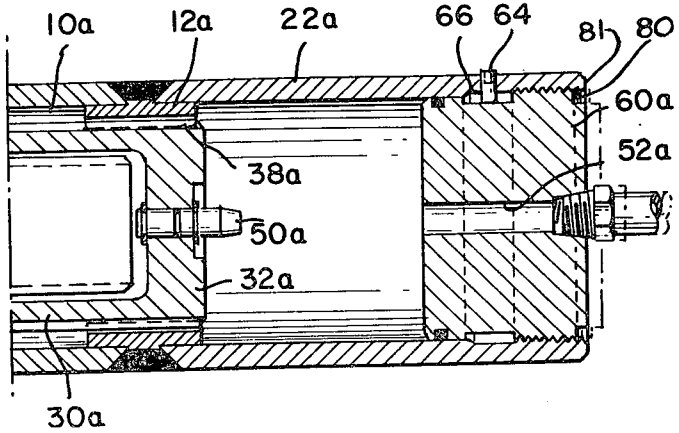
FIG. 1A is a second embodiment of a portion of the helical actuator as shown in FIG. 1.

In the embodiment of FIG. 1 the torque transmitting section is a clearance section and the second section 22 is the sealing section. In the embodiment of FIG. 1A the torque transmitting section **10*a* is a sealing section and the second section 22*a*** is the clearance section. The designations clearance and sealing are in regard to the location of the sealing rings on the piston to be described.

In the embodiment of FIG. 1, a piston sleeve 30 is provided at its end with a piston 32 having seals 34 which slide on the cylindrical inside surface of the sealing section 22. The piston sleeve 30 is hollow and on its outer surface is provided with helical splines 36 that mesh with helical splines 38 in the ring gear 12. On its inside surface the piston sleeve 30 has helical splines in a short ring gear 39 which mesh with helical splines 40 on the exterior surface of an output shaft 42. Thus, reciprocal movement of the piston sleeve causes the piston sleeve to rotate simultaneously and causes the rotary actuator to rotate twice the amount of rotation simultaneously.

In the embodiment of FIG. 1A the ring gear **12*a* is provided with splines 38*a* which mesh with splines on the piston sleeve 30*a***. In this embodiment, however, the piston (not shown) is on the opposite end of the piston sleeve. The helical splines are otherwise the same as in the preferred embodiment.

In both embodiments the end of the piston is provided with a plug 50 that enters a port 52. As the piston approaches the port 52, the plug enters the port restricting the flow of hydraulic fluid out of the port thus slowing or cushioning the movement of the piston when it hits the end closure of the cylinder. The end closure is preferably a threaded end cap 60. The end cap **60*a* is provided with a set screw 64 that rides in a groove 66 in the end cap. By removing the set screw, the location of the end cap within the cylinder can be adjusted to limit the extent of movement of the piston thus limiting the output rotation of the shaft 42. Once the desired location is established the set screw 64** can be reinserted to prevent rotation of the end cap.

At the opposite end of the piston sleeve the piston sleeve is provided with a flange 70 which passes closely to a ring 72. When the flange 70 enters the ring 72 flow from the port 76 is restricted, thus reducing the speed of the piston sleeve and cushioning its impact at the end of its stroke to the left as viewed in FIG. 1.

In the method of manufacturing the actuator, the torque transmitting section 10 is welded to the ring gear 14 and the splines 38 cut in the embodiment of FIG. 1, or the second section 22*a* is welded also to the ring gear 12*a* and then the splines 38*a* are cut. In both embodiments, however, the final cutting of the teeth of the ring gear is very accurately controlled providing ease of alignment of the splines of the piston sleeve in the final assembly.

The end cap also is provided with a gauging shoulder 80. The gauging shoulder is provided as an indicator to show the operator the outward extent of adjustment to safely have occur in the end cap. As the gauging shoulder 80 is moved with the end cap and becomes flush with the edge 81 of cylinder 22*a*, the operator thus knows the design limits for safe use of the threads in the end cap have been reached and no further outward adjustment should be made.

While the preferred embodiments of the invention have been illustrated and described, it should be understood that variations will be apparent to one skilled in the art without departing from the principles herein. Accordingly, the invention is not to be limited to the specific form illustrated in the drawing.

I claim:

1. A helical rotary actuator comprising a cylindrical torque transmitting first section surrounding a linear-to-rotary force transmission chamber and a cylindrical second section, a base adapted to be secured to a support surface, said torque transmitting first section being rigidly secured to said base for transmitting reaction torque thereto, a separate, independent ring gear having teeth projecting radially inward of said torque transmitting first section into said chamber, and weld means integrally connecting said first section to said ring gear for transmitting torque between said ring gear and said first section, said base including a bearing section having a bearing, a rotary output shaft in said bearing, piston means reciprocably mounted within one of said sections and helical spline means within said chamber drivingly interconnected to said ring gear, piston means and rotary output shaft for rotating said output shaft in response to reciprocation of said piston means.

2. The actuator of claim 1, said first and second sections each being welded to said ring gear.

3. The actuator of claim 1, said torque transmitting first section being a clearance section, said second section being a sealing section, said piston means having a sealing ring mounted for movement in said sealing section, and hydraulic cushioning means on opposite ends of said piston means.

4. The actuator of claim 3, said hydraulic cushioning means including a plug extending from an end of said piston means, said second section remote from said base having an end closure with a fluid port therein, said plug engaging within said port to restrict flow as the piston means approaches said end closure, said cushioning means also including a flow restricting surface adjacent said base, said base including a flow restricting ring and a fluid port remote from said piston means wherein movement of said piston means toward said base will bring the flow restricting surface close to said flow restricting ring to restrict flow.

5. A helical rotary actuator comprising a cylinder having a torque transmitting section, means adapted to secure said section to a support surface, a separate, independent ring gear, weld means positively connecting said ring gear to said section for transmitting torque therebetween without slippage, an output shaft within said section, the linear-to-rotary, helically splined, motion conversion means between said shaft and said ring gear, including a piston linearly reciprocable within said cylinder, and wherein movement of said piston results in rotary motion between said shaft and cylinder, with reaction torque being transmitted from said ring gear to said torque transmitting section and thence to said support surface.

* * * * *